US008152003B1

(12) United States Patent
Kao

(10) Patent No.: US 8,152,003 B1
(45) Date of Patent: Apr. 10, 2012

(54) TOOL HANGER ASSEMBLY

(76) Inventor: Jui-Chien Kao, Tali (TW)

( * ) Notice: Subject to any disclaimer, the term of this patent is extended or adjusted under 35 U.S.C. 154(b) by 0 days.

(21) Appl. No.: 12/979,019

(22) Filed: Dec. 27, 2010

(51) Int. Cl.
*A47F 7/00* (2006.01)

(52) U.S. Cl. ..... 211/70.6; 211/94.01

(58) Field of Classification Search ..... 211/70.6, 211/69, 66, 70.8, 89.01, 94.01, 162; 206/349, 206/372, 378; 248/220.31
See application file for complete search history.

(56) References Cited

U.S. PATENT DOCUMENTS 3,980,384 A * 9/1976 Lawson ..... 439/710
4,781,608 A * 11/1988 Hillmann ..... 439/212
4,961,505 A * 10/1990 Moeller ..... 211/70.8
5,544,747 A * 8/1996 Horn ..... 206/378
6,070,745 A * 6/2000 Dembicks ..... 211/70.6
6,168,018 B1 * 1/2001 Ramsey et al. ..... 206/378
6,431,373 B1 * 8/2002 Blick ..... 211/70.6
6,488,151 B2 * 12/2002 Ramsey et al. ..... 206/378
7,258,239 B2 * 8/2007 Kao ..... 211/70.6
2006/0207951 A1 * 9/2006 Wang ..... 211/70.6
2008/0047911 A1 * 2/2008 Kao ..... 211/70.6
2009/0090644 A1 * 4/2009 Kao ..... 206/373
2009/0184070 A1 * 7/2009 Kao ..... 211/70.6
2009/0194494 A1 * 8/2009 Kao ..... 211/70.6

* cited by examiner

*Primary Examiner* — Darnell Jayne
*Assistant Examiner* — Stanton L Krycinski
(74) *Attorney, Agent, or Firm* — WPAT, P.C.; Anthony King

(57) ABSTRACT

A tool hanger assembly has a frame and a hanger. The frame has a back plate and a bracket. The bracket is mounted securely on the back plate and has a track formed in a top of the bracket. The hanger is mounted securely on the frame and has a base plate and multiple pillars. The base plate is mounted securely in the track. The pillars are securely mounted on the base plate at intervals to allow sleeves to be mounted around. Accordingly, to assemble the hanger having the multiple pillars with the frame is quick, reduces assembling cost and is convenient.

5 Claims, 14 Drawing Sheets

TOOL HANGER ASSEMBLY

BACKGROUND OF THE INVENTION

1. Field of the Invention

The present invention relates to a tool hanger assembly, and more particularly to a tool hanger assembly to save time for assembling.

2. Description of Related Art

A conventional tool hanger assembly has a frame and multiple hangers. The frame has a track formed in a side surface of the frame. The hangers are slidably mounted in the track and each hanger has a seat protruding from the hanger. Each hanger has a pillar mounted securely on the seat to allow a sleeve to be mounted around.

However, the multiple hangers have to be slid into the track one by one, such that assembling the multiple hangers onto the frame is time-consuming, increases assembling cost and is not convenient.

Additionally, each hanger does not have a flat bottom surface, such that the conventional tool hanger assembly can only be hung on a display board and cannot be positioned on a flat surface.

To overcome the shortcomings, the present invention intends to provide a tool hanger assembly to obviate the aforementioned problems.

SUMMARY OF THE INVENTION

The main objective of the present invention is to provide a tool hanger assembly to save time for assembling.

A tool hanger assembly has a frame and a hanger. The frame has a back plate and a bracket. The bracket is mounted securely on the back plate and has a track formed in a top of the bracket. The hanger is mounted securely on the frame and has a base plate and multiple pillars. The base plate is mounted securely in the track. The pillars are securely mounted on the base plate at intervals to allow sleeves to be mounted around. Accordingly, to assemble the hanger having the multiple pillars with the frame is quick, reduces assembling cost and is convenient.

DETAILED DESCRIPTION OF PREFERRED EMBODIMENT

Figure 1:
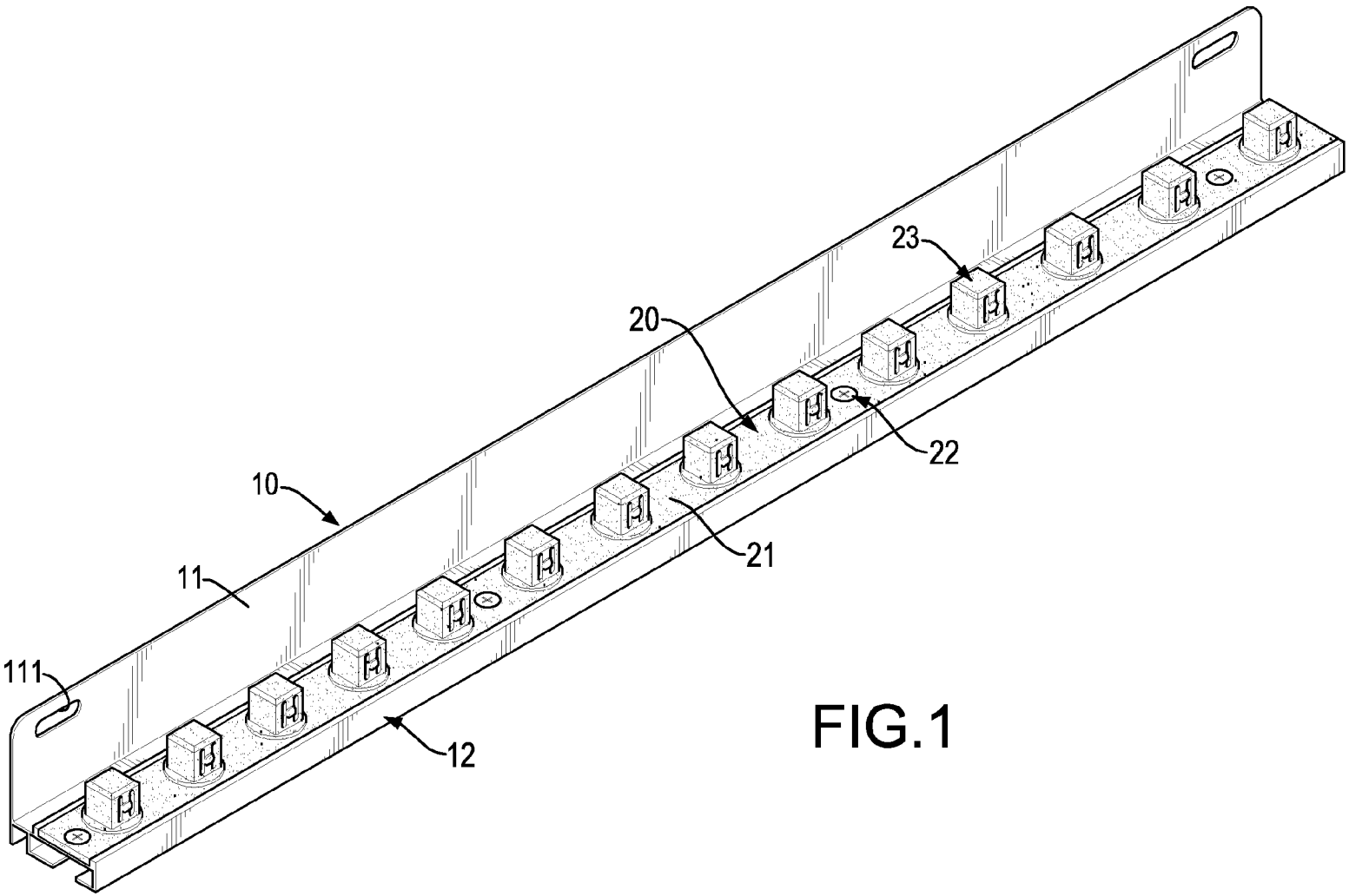
FIG. 1 is a perspective view of a first embodiment of a tool hanger assembly in accordance with the present invention.
Figure 2:
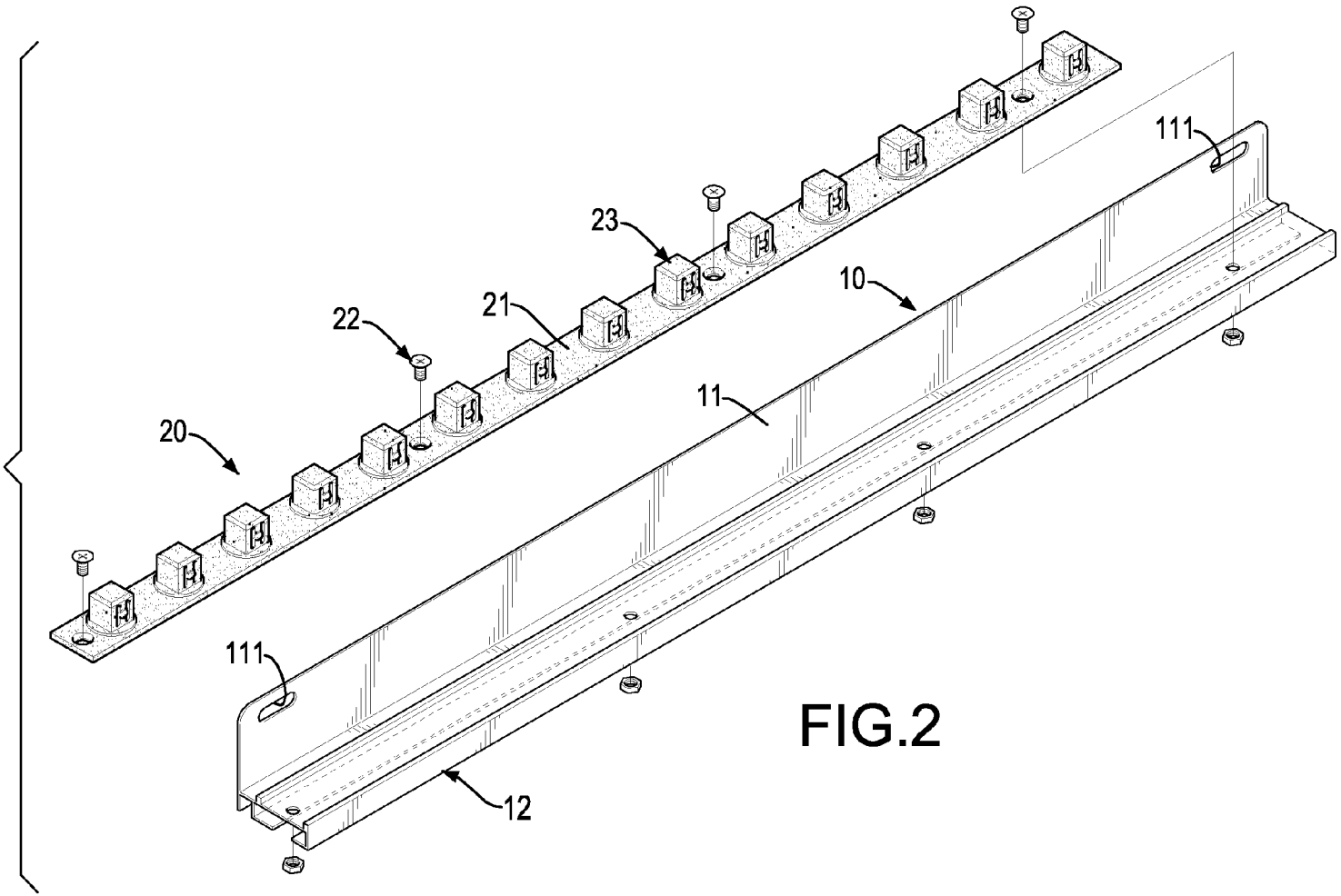
FIG. 2 is an exploded perspective view of the tool hanger assembly in FIG. 1.
Figure 3:
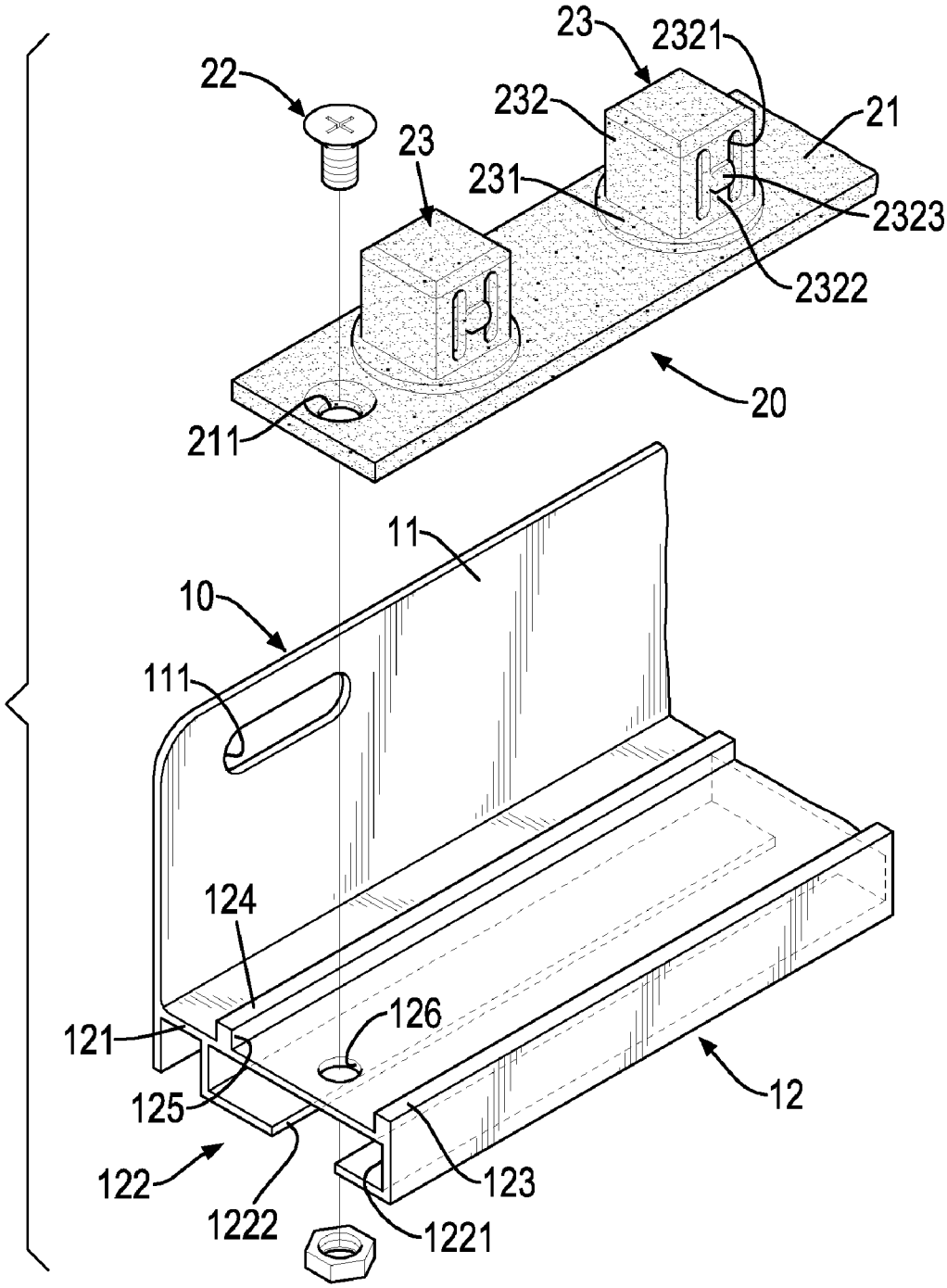
FIG. 3 is an enlarged exploded perspective view of the tool hanger assembly in FIG. 1.

With reference to FIGS. 1 to 5, a first embodiment of a tool hanger assembly in accordance with the present invention comprises a frame 10 and a hanger 20.

The frame 10 has a back plate 11 and a bracket 12. The back plate 11 is elongated and has a side surface, a top, a bottom, two opposite ends and two mounting holes 111. The bottom of the back plate 11 is opposite to the top of the back plate 11. The mounting holes 111 are formed through near the top and respectively near the opposite ends of the back plate 11.

The bracket 12 is elongated, is mounted securely on the back plate 11 and has a connecting plate 121, a seat plate 122, a front protrusion 123, a back protrusion 124, a track 125 and multiple through holes 126. The connecting plate 121 is mounted securely on the side surface near the bottom of the back plate 11 and has a distal portion opposite to the back plate 11.

The seat plate 122 is mounted securely on the distal portion of the connecting plate 121 and has two opposite ends, a rectangular cross section, a top section, a length, a bottom surface, an extending channel 1221 and an opening 1222. The length of the seat plate 122 is the same as that of the side surface of the back plate 11. The bottom surface of the seat plate 122 is flat and is located at a horizontal plane flush with the bottom of the back plate 11. The extending channel 1221 is formed inside the seat plate 122, is formed through the ends of the seat plate 122 and has a rectangular cross section.

The opening 1222 is formed in the bottom surface of the seat plate 122, communicates with the extending channel 1221 and has a length the same as that of the back plate 11.

The front protrusion 123 is formed on and protrudes upward from the top section of the seat plate 122.

The back protrusion 124 is formed on and protrudes upward from the top section of the seat plate 122, is parallel to the front protrusion 123 and is located between the front protrusion 123 and the connecting plate 121.

The track 125 is defined as a space between the front protrusion 123, the back protrusion 124 and the top section of the seat plate 122 and has a rectangular cross section.

The through holes 126 are formed through the top section of the seat plate 122 at intervals, are located between the front protrusion 123 and the back protrusion 124 and communicate with the extending channel 1221.

The hanger 20 is mounted securely on the frame 10 and has a base plate 21, multiple screwing devices 22 and multiple pillars 23.

The base plate 21 is mounted securely in the track 125 and has a top and multiple connecting holes 211. The connecting holes 211 are formed through the base plate 21 and respectively align with the through holes 126.

The screwing devices 22 are mounted respectively through the connecting holes 211 and are respectively mounted securely through the through holes 126. Each screwing device 22 has a bolt and a nut screwed with the bolt to connect securely the hanger 20 with the frame 10.

The pillars 23 are formed on the top of the base plate 21 at intervals and are located between the front protrusion 123 and the back protrusion 124. Each pillar 23 has a support 231, a post 232 and a pillar hole 233. The supports 231 are mounted securely on the top of the base plate 21 at intervals and are located between the front protrusion 123 and the back protrusion 124. The posts 232 are respectively mounted securely on tops of the supports 231 and respectively have a square cross section.

The pillar holes 233 are respectively formed through the base plate 21 and the supports 231, are respectively formed in the posts 232 and respectively have a top.

Preferably, each post 232 has an aperture 2321, a tab 2322 and a knob 2323. The apertures 2321 are respectively formed through the posts 232, communicate with the tops of the pillar holes 231 and respectively have two opposite sides. The tabs 2322 are respectively mounted in the apertures 2321, are respectively connected with the opposite sides of the apertures 2321 and respectively have a central segment. The knobs 2323 are respectively mounted securely on the central segments of the tabs 2322 and protrude outwardly.

The pillars 23 may not have the pillar holes 233, the tabs 2322 and the knobs 2323 and still allow sleeves 30 to be mounted around in position. The present invention does not limit the format of the pillars 23.

Figure 6:
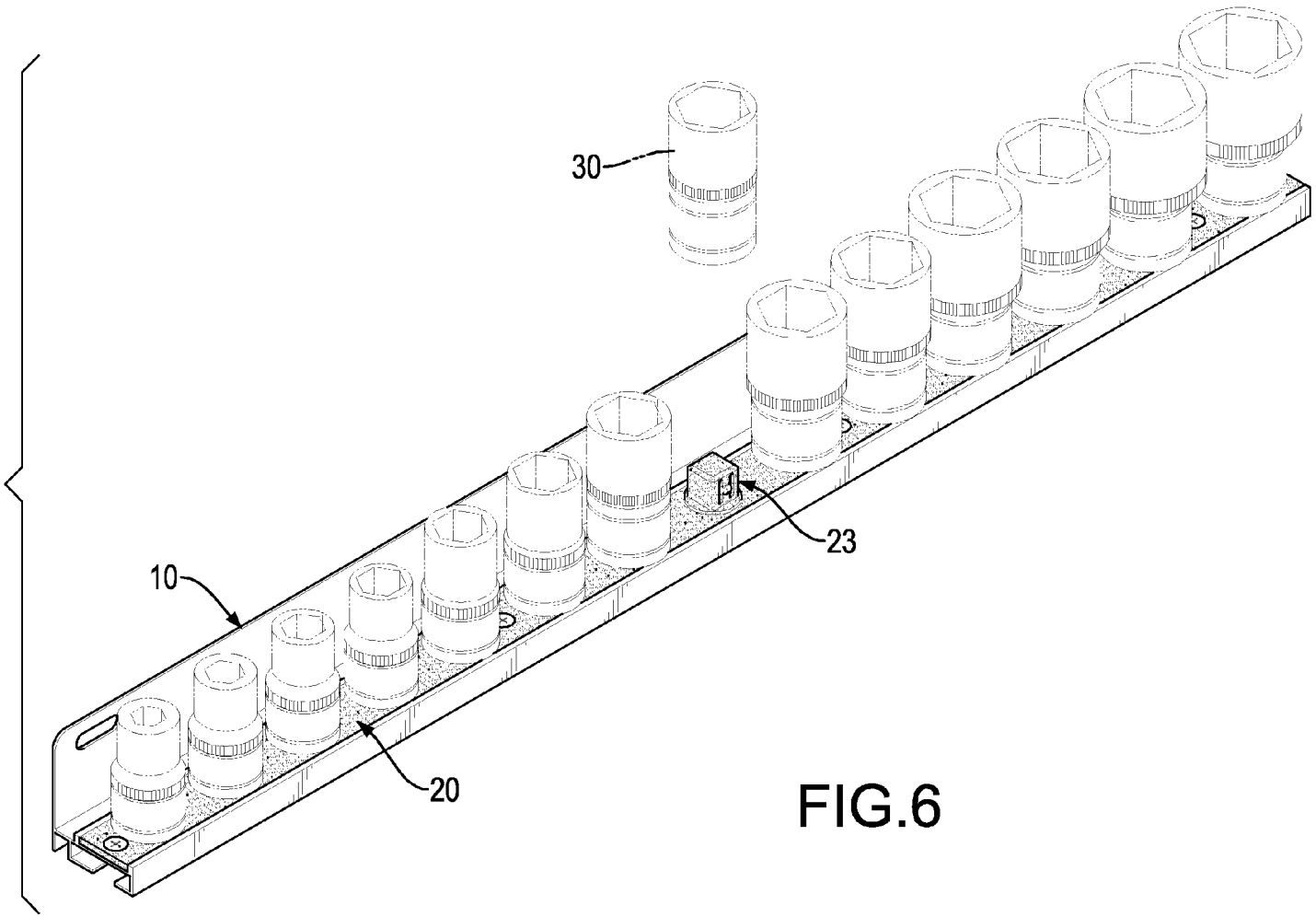
FIG. 6 is an operational perspective view of the tool hanger assembly in FIG. 1, wherein multiple sleeves are respectively mounted around the pillars.
Figure 7:
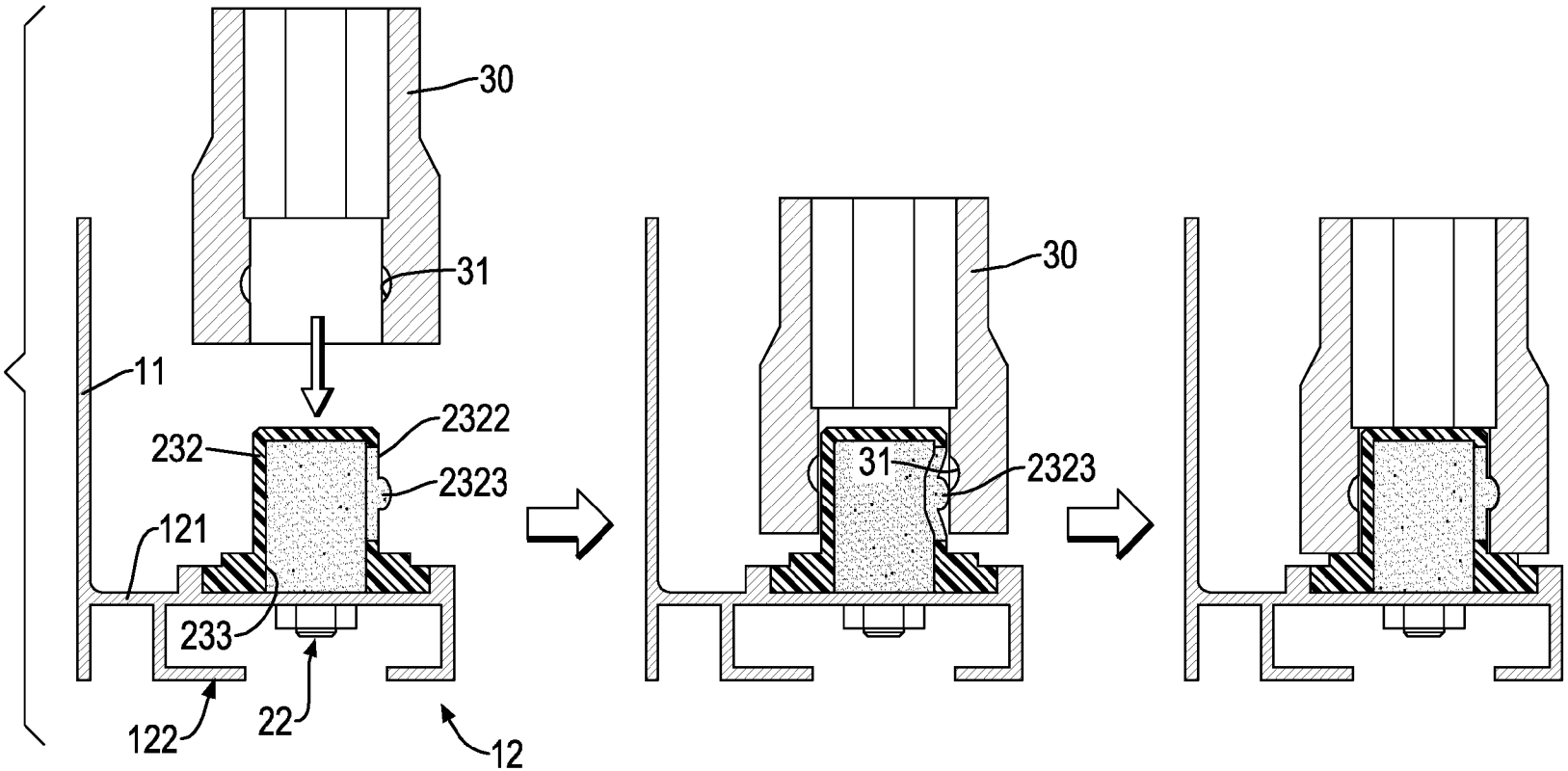
FIG. 7 shows operational cross sectional views of the tool hanger assembly, showing a process of mounting a sleeve around a pillar.

With reference to FIGS. 6 and 7, while the sleeves 30 are put on the tool hanger assembly, inner surfaces of the sleeves 30 push the knobs 2323 inward the pillar holes 233 and bend the tabs 2322. When the sleeves 30 are respectively mounted around the pillars 23, the tabs 2322 recover to push the knobs 2323 towards recesses 31 of the sleeves 30. Accordingly, with the knobs 2323 engaging the recesses 31 of the sleeves 30, the sleeves 30 can be mounted respectively around the pillars 23.

Figure 4:
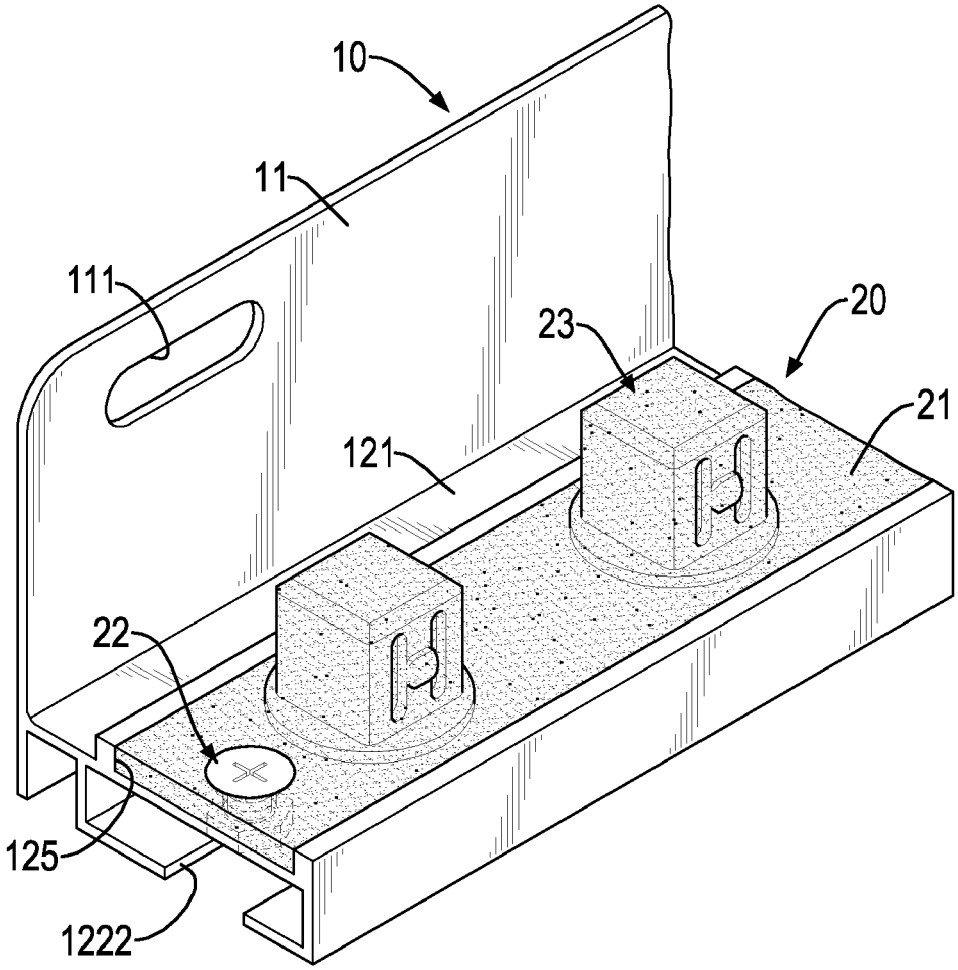
FIG. 4 is an enlarged perspective view of the tool hanger assembly in FIG. 1.
Figure 5:
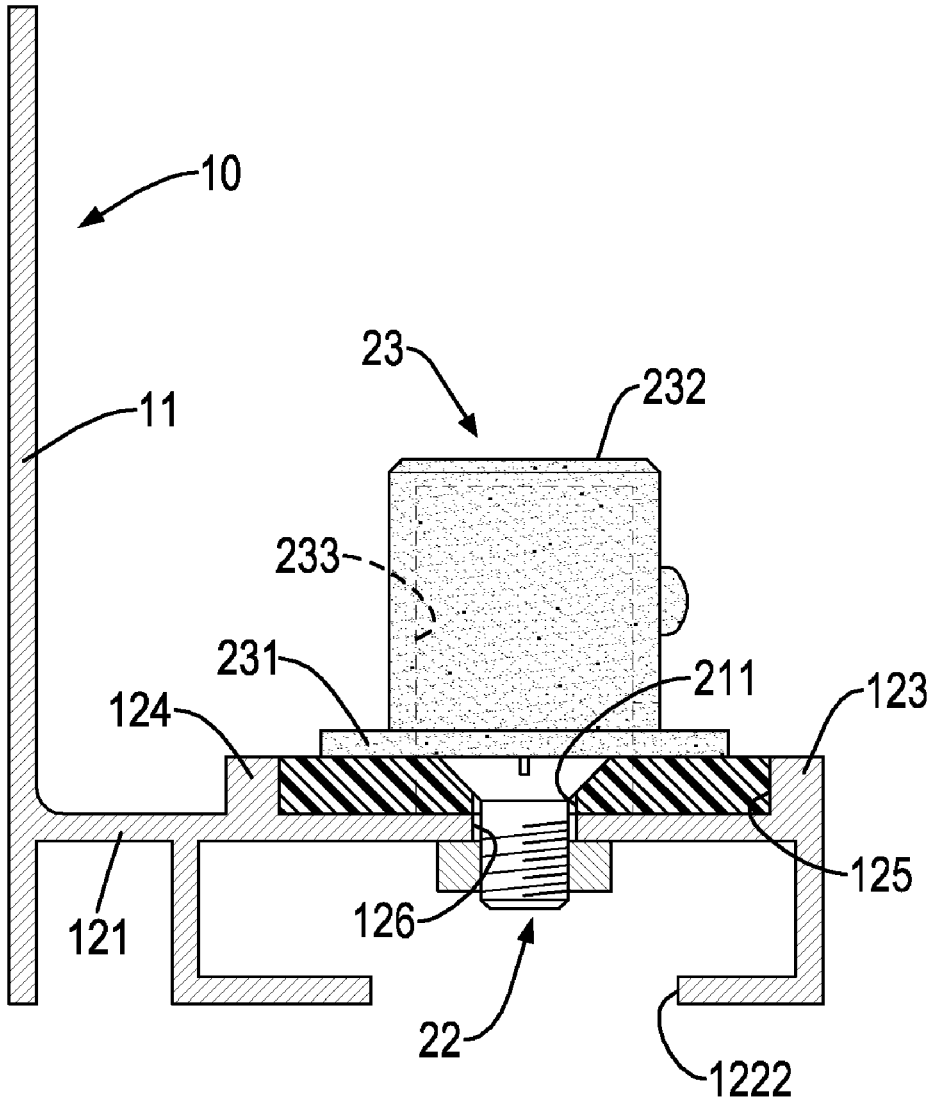
FIG. 5 is an enlarged side view in partial section of the tool hanger assembly in FIG. 1.

With reference to FIGS. 4 and 5, when the hanger 20 is assembled with the frame 10, the base plate 21 is put in the track 125. And then the nuts of the screwing devices 22 are respectively screwed with the bolts via the opening 1222 of the seat plate 122 to connect securely the hanger 20 with the frame 10.

Figure 8:
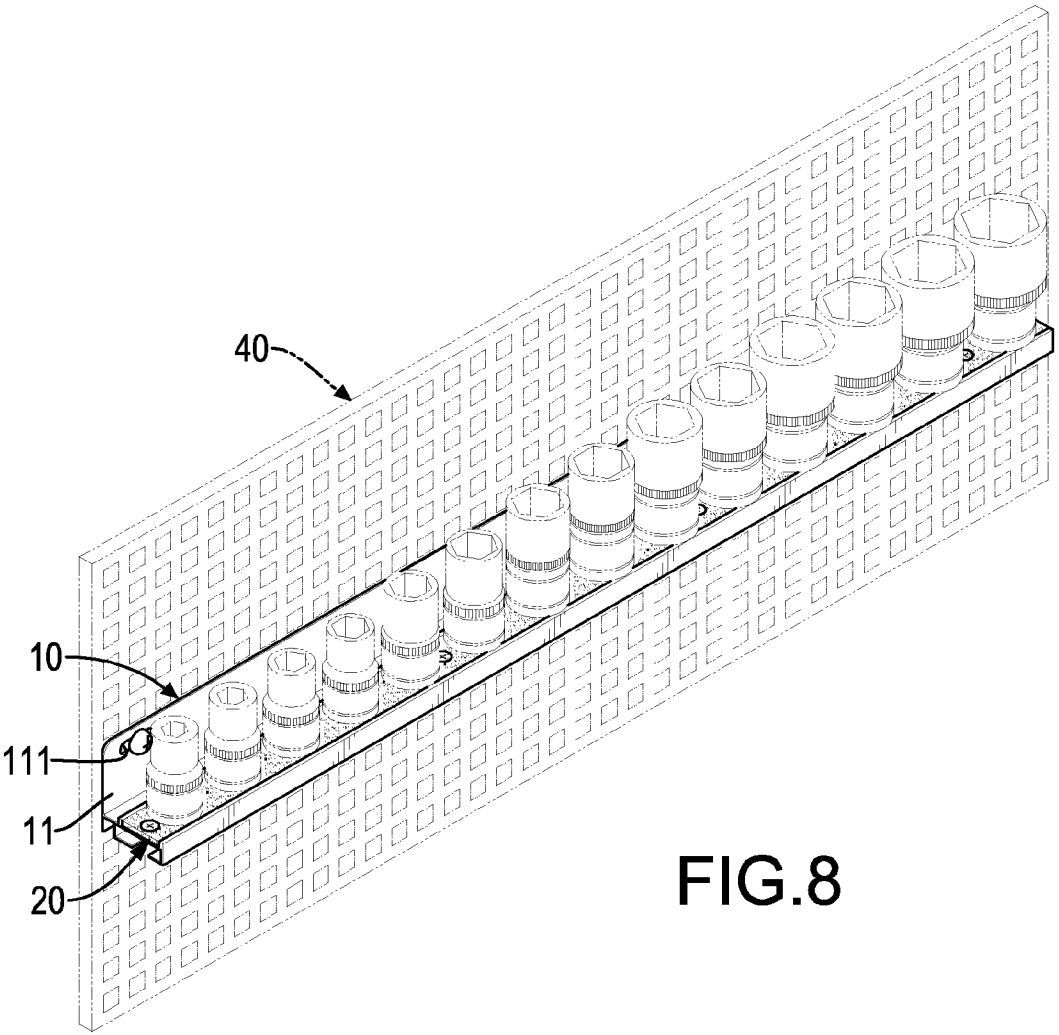
FIG. 8 is a perspective view of the tool hanger assembly, wherein the tool hanger assembly is positioned onto a display board.
Figure 9:
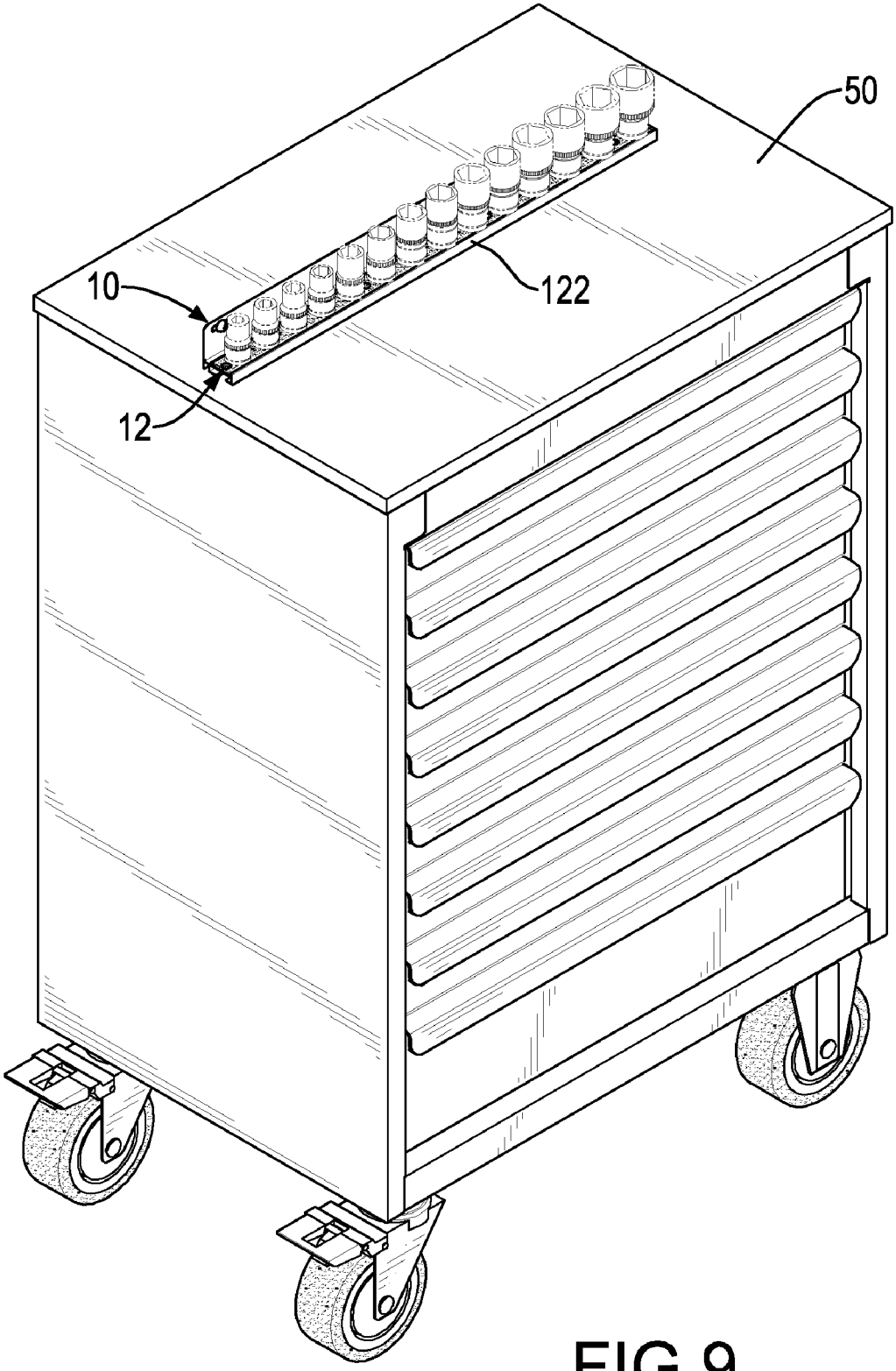
FIG. 9 is a perspective view of the tool hanger assembly, wherein the tool hanger assembly is put on a top of a tool trolley.

With reference to FIG. 8, the tool hanger assembly is hung onto a display board 40 by the mounting holes 111. With reference to FIG. 9, the bracket 12 is steadily put on a top of a tool trolley 50 because the bottom surface of the seat plate 122 of the bracket 12 is flat. Accordingly, the tool hanger assembly can be conveniently positioned on any flat surface.

Figure 10:
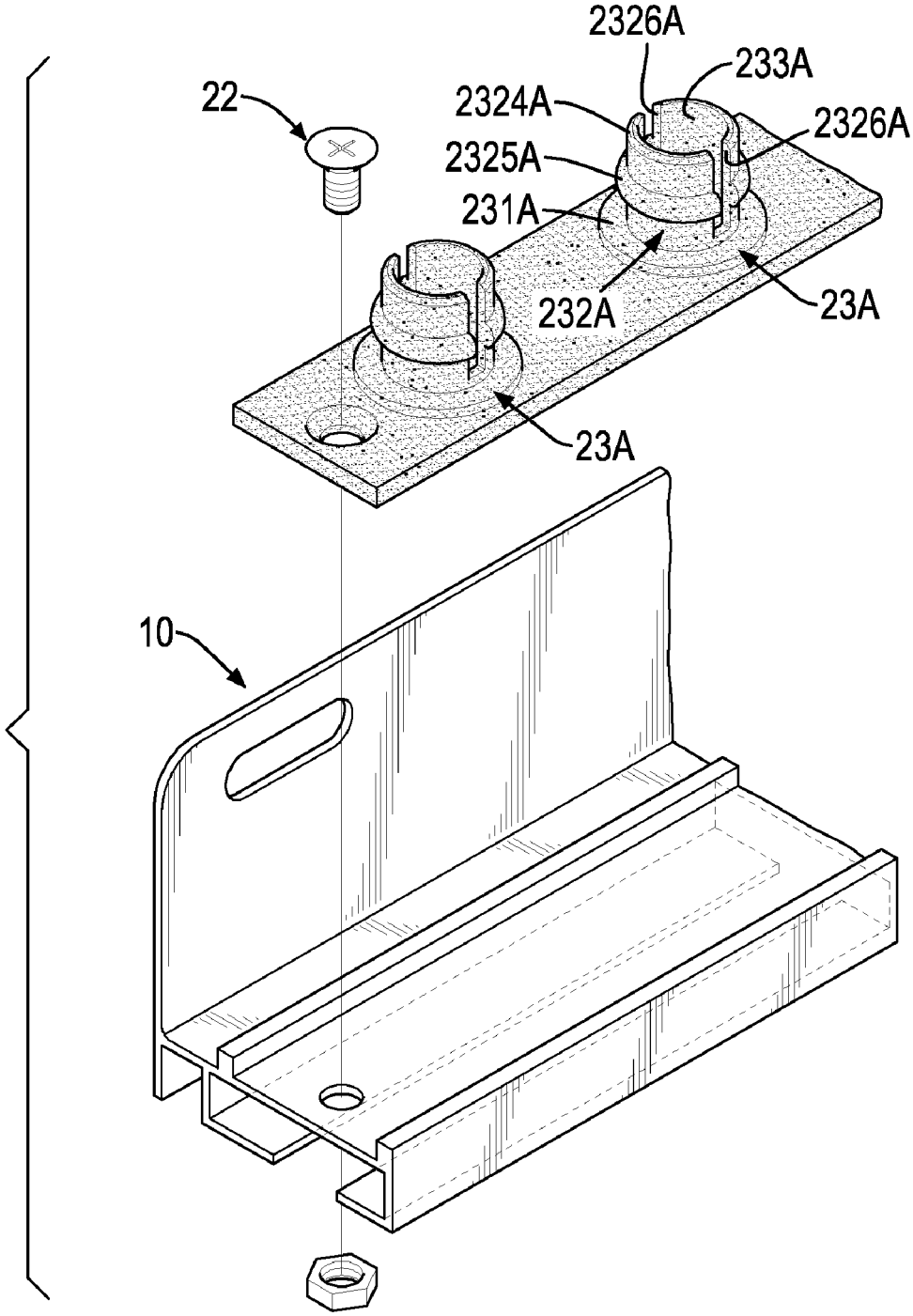
FIG. 10 is an enlarged exploded perspective view of a second embodiment of the tool hanger assembly in accordance with the present invention.
Figure 11:
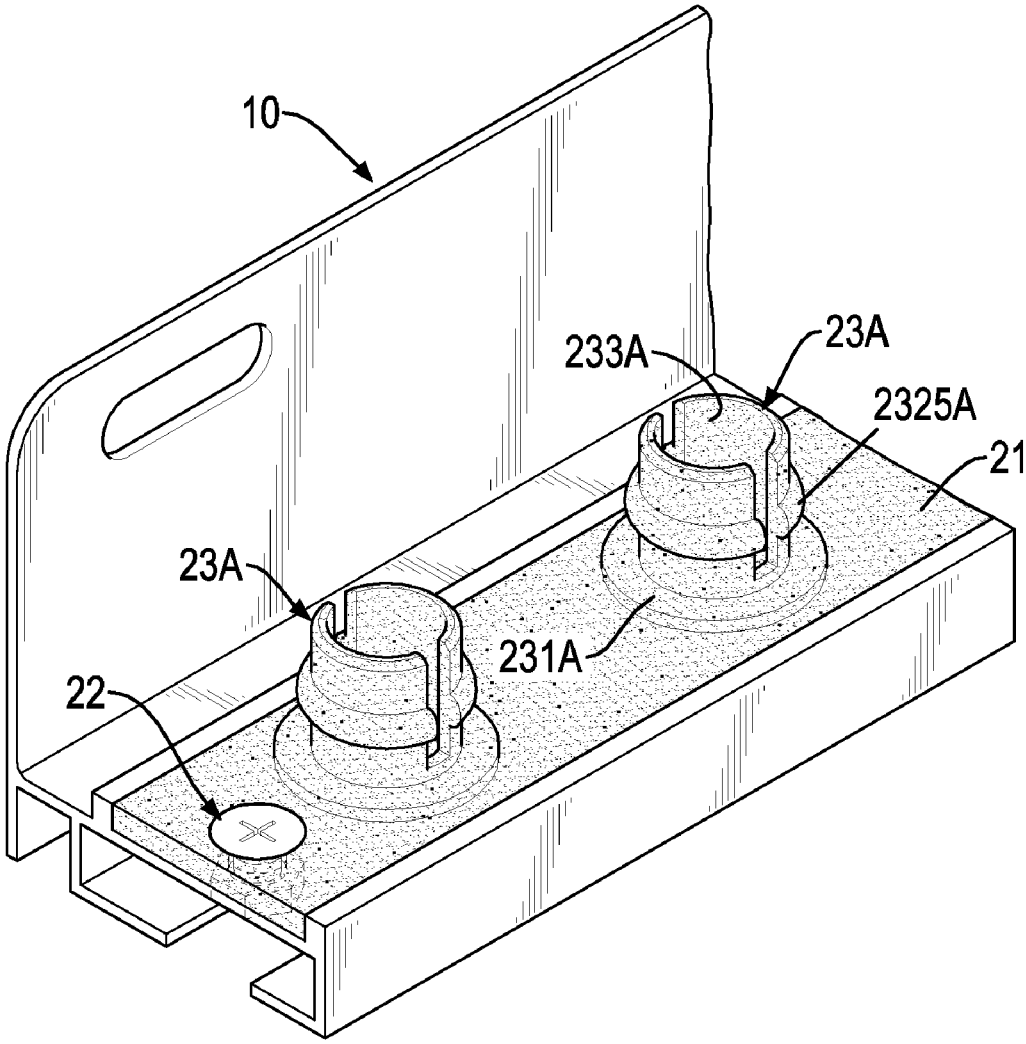
FIG. 11 is an enlarged perspective view of the tool hanger assembly in FIG. 10.
Figure 12:
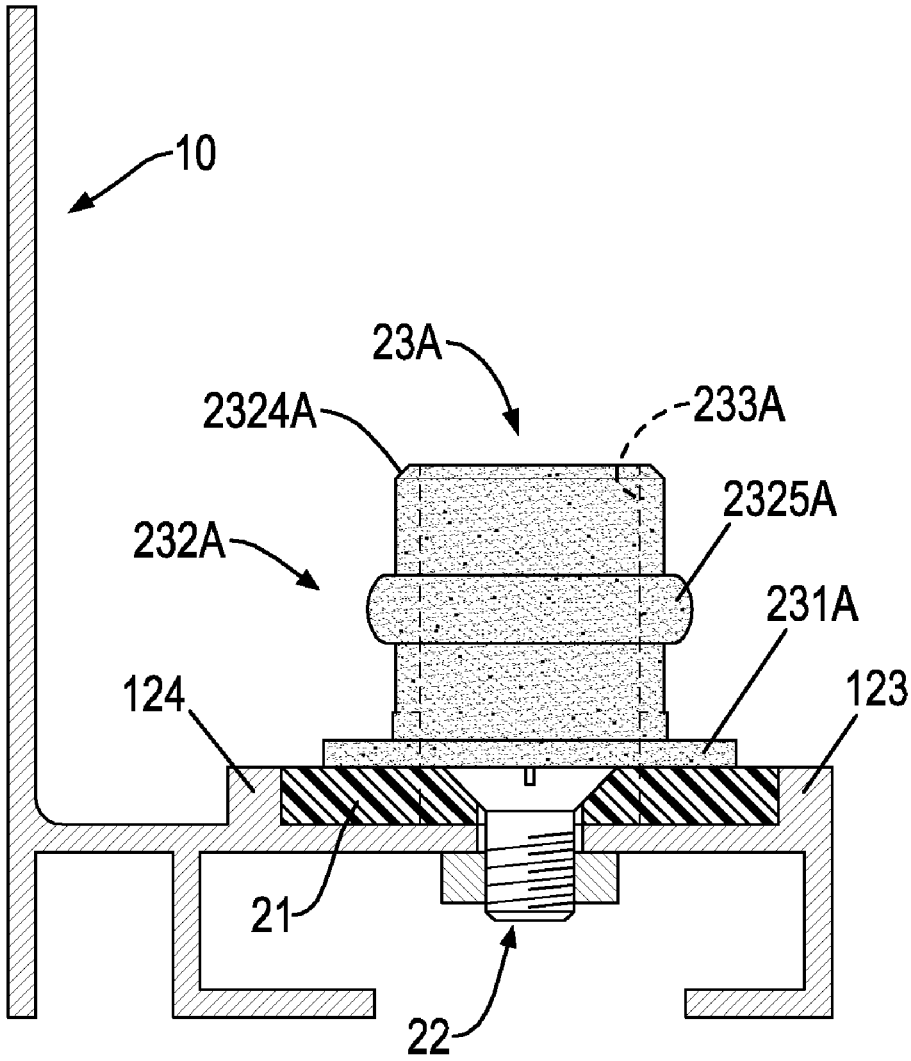
FIG. 12 is an enlarged side view in partial section of the tool hanger assembly in FIG. 11.

With reference to FIGS. 10 to 12, a second embodiment of the tool hanger assembly is substantially the same as the first embodiment except that each post 232A has a round cross section. The pillar holes 233A are formed through the base plate 21 and are respectively and axially formed through the supports 231A and the posts 232A. Each post 232A has a top rim 2324A, a flange 2325A and two gashes 2326A. Each flange 2325A is annular and radially formed around the post 232A. The gashes 2326A of each post 232A are respectively formed through the top rim 2324A and the flange 2325A, are diametrically opposite to each other and communicate with the pillar hole 233A.

Figure 13:
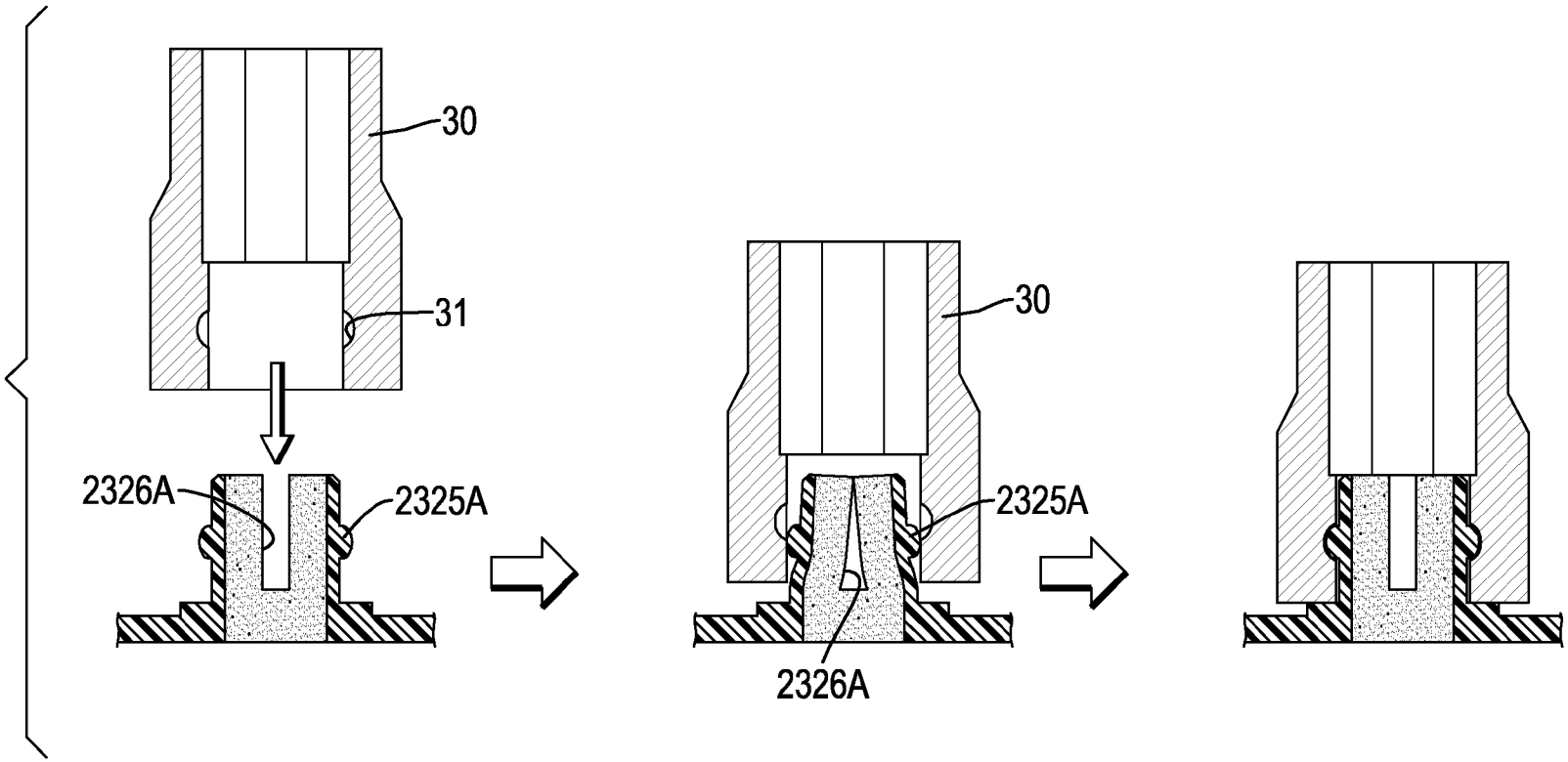
FIG. 13 shows operational cross sectional views of the second embodiments of the tool hanger assembly, showing a process of mounting a sleeve around a pillar.

With reference to FIGS. 10, 12 and 13, while the sleeves 30 are put on the second embodiment of the tool hanger assembly, inner surfaces of the sleeves 30 push the flanges 2325A inward and narrow the gashes 2326A, so the posts 232A can be respectively slid into the sleeves 30. And then the flanges 2325A recover and engage the recesses 31 of the sleeves 30. The hanger 20 with the multiple pillars 23 can hang the multiple sleeves 30. Because combining the hanger 20 having the multiple pillars 23 with the frame 10 is easy, to assemble the hanger 20 with the frame 10 is quick, reduces assembling cost and is convenient for hanging multiple sleeves 30.

Figure 14:
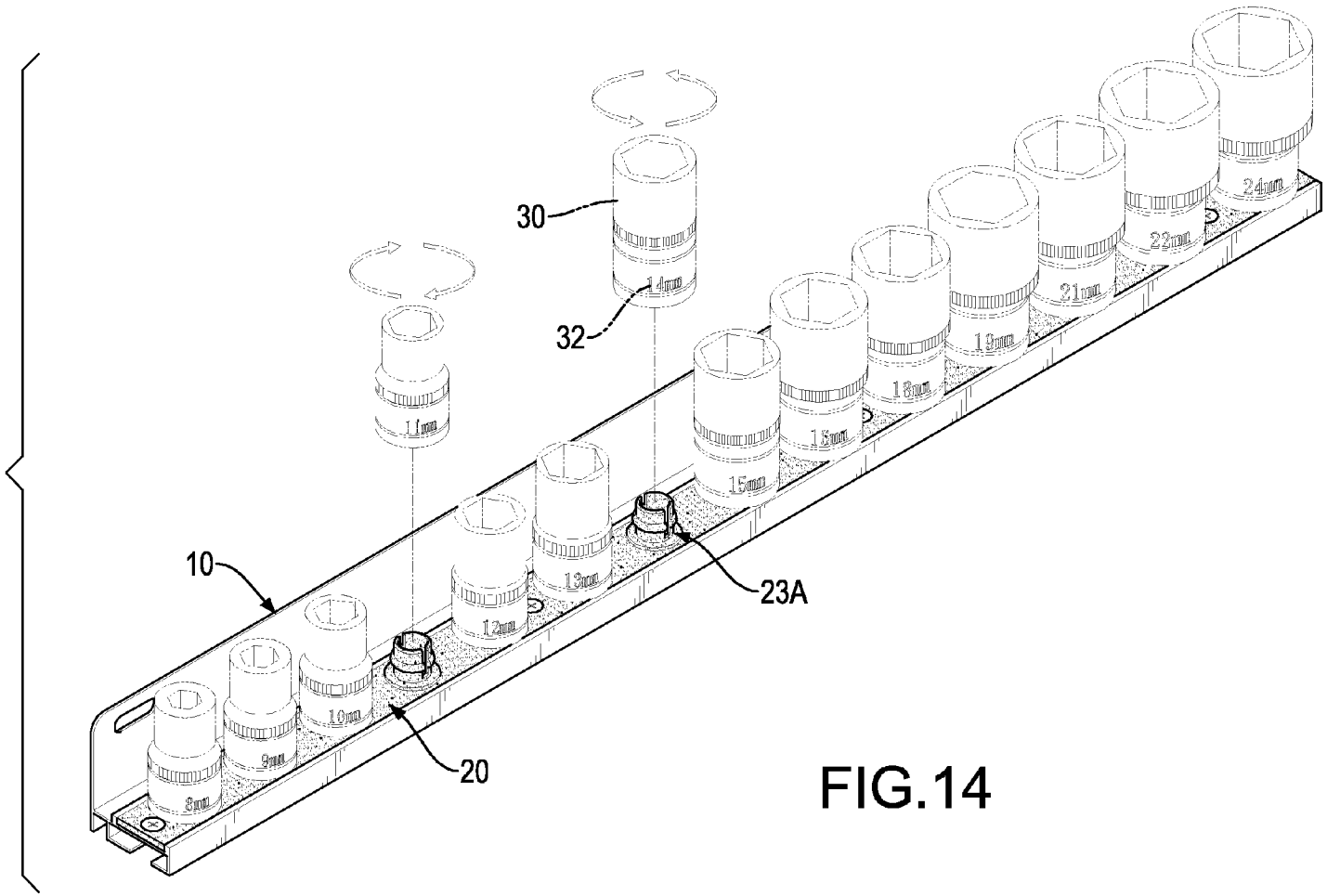
FIG. 14 is an operational perspective view of the tool hanger assembly in FIG. 11, wherein multiple sleeves are respectively mounted around the pillars.

With reference to FIG. 14, each sleeve 30 has a size sign 32 which is printed on an outer surface of the sleeve 30 by rolling, such that each size sign 32 is often printed on an uncertain position of the sleeve 30. Accordingly, the size signs 32 can not be rotated to face a user when the sleeves 30 are mounted around the square pillars 23A. Because the pillars 23A of the second embodiment are round, the sleeves 30 are easily rotated clockwise or counterclockwise to make the size signs 32 of the sleeves 30 always face a user.

What is claimed is:

1. A tool hanger assembly comprising:

a frame having an elongated back plate having a top;

a bottom opposite to the top of the back plate;

two opposite ends;

a side surface; and two mounting holes formed through near the top and respectively near the opposite ends of the back plate; and an elongated bracket mounted securely on the back plate and having a connecting plate mounted securely on the side surface near the bottom of the back plate and having a distal portion opposite to the back plate;

a seat plate mounted securely on the distal portion of the connecting plate and having two opposite ends;

a rectangular cross section;

a top section;

a length the same as that of the side surface of the back plate;

a flat bottom surface located at a horizontal plane flush with the bottom of the back plate;

an extending channel formed inside the seat plate, formed through the ends of the seat plate and having a rectangular cross section;

an opening formed in the bottom surface of the seat plate, communicating with the extending channel and having a length the same as that of the back plate; and a front protrusion formed on and protruding upward from the top section of the seat plate;

a back protrusion formed on and protruding upward from the top section of the seat plate, parallel to the front protrusion and located between the front protrusion and the connecting plate;

a track defined as a space between the front protrusion, the back protrusion and the top section of the seat plate; and multiple through holes formed through the top section of the seat plate at intervals, located between the front protrusion and the back protrusion and communicating with the extending channel; and a hanger mounted securely on the frame and having a base plate mounted securely in the track and having a top and multiple connecting holes which are formed through the base plate and respectively align with the through holes;

multiple screwing devices respectively mounted securely through the connecting holes and respectively mounted securely through the through holes, each screwing device having a bolt and a nut screwed with the bolt; and multiple pillars formed on the top of the base plate at intervals and located between the front protrusion and the back protrusion.

2. The tool hanger assembly as claimed in claim 1, wherein each pillar has a support mounted securely on the top of the base plate, located between the front protrusion and the back protrusion and having a top; and a post mounted securely on the top of the support and having a square cross section.

3. The tool hanger assembly as claimed in claim 2, wherein each pillar has a pillar hole formed through the base plate and the support of the pillar, formed in the post of the pillar and having a top; and each post has an aperture formed through the post, communicating with the top of the pillar hole in the post and having two opposite sides;

a tab mounted in the aperture, connected with the opposite sides of the aperture and having a central segment; and a knob mounted securely on the central segment of the tab and protruding outwardly.

4. The tool hanger assembly as claimed in claim 1, wherein each pillar has a support mounted securely on the top of the base plate, located between the front protrusion and the back protrusion and having a top; and a post mounted securely on the top of the support and having a round cross section.

5. The tool hanger assembly as claimed in claim 4, wherein each pillar has a pillar hole formed through the base plate and axially formed through the support and the post of the pillar; and each post has a top rim;

an annular flange radially formed around the post; and two gashes respectively and radially formed through the top rim and the flange, being diametrically opposite to each other and communicating with the pillar hole.

* * * * *